US006395040B1

(12) United States Patent
Tulgar

(10) Patent No.: US 6,395,040 B1
(45) Date of Patent: May 28, 2002

(54) PROCESS FOR PRODUCING LEATHER

(75) Inventor: Ned Tulgar, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 0 days.

(21) Appl. No.: 09/561,162

(22) Filed: Apr. 28, 2000

(51) Int. Cl.[7] ..... C14C 1/00; C14C 3/00; C14C 5/00; B05D 3/00; B05D 3/02

(52) U.S. Cl. ..... 8/94.1 R; 8/94.4 R; 8/94.15; 8/94.18; 8/94.19 R; 8/94.22; 8/94.27; 8/94.23; 427/323; 427/389

(58) Field of Search ..... 8/94.1 R, 94.4 R, 8/94.15, 94.18, 94.19 R, 94.22, 94.27, 94.33; 427/323, 389

(56) References Cited

U.S. PATENT DOCUMENTS 5,472,741 A * 12/1995 Sackmann et al. ..... 427/389
5,728,313 A * 3/1998 Ritter et al. ..... 252/8.57
5,980,578 A * 11/1999 Kausses et al. ..... 8/94.21

* cited by examiner

*Primary Examiner*—Yogendra N. Gupta
*Assistant Examiner*—Derrick G. Hamlin
(74) *Attorney, Agent, or Firm*—Warner Norcross & Judd LLP

(57) ABSTRACT

A method for producing leather generally including the steps of: (a) providing wet blue, full grain skins, (b) applying a liquid chrome solution to the skins while at a pH of 3.5 or lower, (c) raising the pH level of the skins to at least approximately 6.0 or above, (d) retaining the skins with a vegetable tanning agent, (e) introducing the skins to a dye bath, (f) introducing lubricants into the dye bath, (g) fixing the dyestuff and lubricants in the skins while reducing the pH level to the range of 3.3–3.8, (g) introducing the skins to a second dye bath, (h) fixing the dyestuff while reducing the pH level to a range of 3.0–3.5, (i) introducing the skins to a float containing a waterproofing agent, (j) fixing the waterproofing agent while reducing the pH level to approximately 3.0, (k) capping the skins to remove emulsifiers, and (1) introducing the skins to a bath containing flame resistant agents.

31 Claims, 8 Drawing Sheets

PROCESS FOR PRODUCING LEATHER

BACKGROUND OF THE INVENTION

The present invention relates to methods for the production of leather, and more particularly to a process for producing leather from wet blue pig skins.

A wide variety of methods are used commercially for producing leather from skins or hides. In general, leather production involves three broad phases. First, the skins or hides are prepared for tanning. This generally involves curing the skins so that they do not begin to decompose before tanning. At the tannery, the skins are typically soaked in water to remove all water-soluble materials, such as salt, blood, and dirt, and to replace moisture lost in the curing process. Typically, the next step is to remove hair from the skins. Often, this is done by soaking the skins in a lime solution and then mechanically removing the hair, along with extraneous flesh and tissue, by machine. The next general step is "delimiting," which removes the lime introduced during the dehairing step. The deliming process involves soaking the skins in a mild acid solution. Bating may also occur at this time. Bating is a process in which the skins are treated with enzymes that make the skins soft and flexible and provide them with a smoother grain.

The bated skins are then tanned using any of a variety of conventional tanning methods. For example, the skins may be tanned in a mineral tanning process. In mineral tanning, the skins are soaked in a mineral tanning agent, typically the salt compound of chromium. To prepare the bated skins for chrome tanning, the skins are pickled in a conventional salt and acid brine. Once pickled, the skins are tumbled in a chromium-sulfate solution containing liquors that enhance the skins' ability to absorb the tanning agent. Alternatively, the skins may be tanned in a vegetable tanning process. Vegetable tanning generally involves soaking the skins in a tannin solution containing liquors that improve and speed the absorption of tannin. Tannin is typically extracted from wood or bark, such as the chestnut wood or oak bark. The skins are soaked in successively stronger solutions until they have absorbed the appropriate amount of tannin for the particular application.

The tanned skins, which in the case of chrome tanned skins are sometimes referred to as "wet blue leather," are then subjected to a variety of treatments that provide the skins with the desired characteristics. For example, the skins can be lubricated using a blend of oils and greases, and dyed to the desired color through drum dyeing, spraying, brush dyeing or staining processes. In some applications, the skins are retanned to introduce additives that provide the skins with desirable characteristics. For example, waterproofing agents are typically introduced during a retanning process. Waterproofing is a particularly important characteristic in many applications, including footwear applications. The waterproofness of a leather is typically measured in Maeser flexes, which is essentially the number of flexes that a leather can undergo before it loses the waterproof characteristic. The waterproofness standard set by the U.S. military is 15,000 Maeser flexes. Further, heat resistant and flame resistant agents are often introduced prior to and/or during the retanning process. Finally, the skins are staked and finished. Staking is a mechanical softening process in which the skins are repeatedly beat by fingers. Finishing typically involves the application of a finishing compound, such as oil blend, to the surface of the leather. The above described processes are typical steps involved in the production, but are not exhaustive. Alternative and additional processes are commonplace in the leather production industry.

Although there are a variety of well-known techniques for obtaining leather with one or more desired characteristics, such as softness, suppleness, waterproofness, flame resistance, and heat resistance, it is difficult to produce leather that has the appropriate combination of these characteristics, In fact, these characteristics are achieved only by carefully controlling a complex series of variables in the production process. For example, the precise additive formulation, the quantity of additives, the mixture ratio of additives to water in the various steps, the temperature of the solutions in which the skins are treated, the running time in a given liquor bath and the pH level of the solutions in which the skins are treated are all crucial to the production process. As perhaps the result of these complexities, there remains an unmet need for leather that is highly waterproof, flame resistant and heat resistant and yet remains soft and supple.

SUMMARY OF THE INVENTION

The aforementioned problems are overcome by the present invention wherein a leather production process is provided which produces a leather that is highly waterproof, flame resistant and heat resistant and yet remains soft and supple. The production process generally includes the steps of: (a) providing wet blue, full grain skins, (b) applying a chromium or liquid chrome solution to the skins while at a pH of 3.5 or lower, (c) raising the pH level of the skins to 6.0 or above, (d) retanning the skins with a vegetable tanning agent, (e) introducing the skins to a dye bath, (f) introducing waterproofing lubricants into the dye bath, (g) fixing the dyestuff and waterproofing lubricants in the skins while reducing the pH level to the range of 3.3–3.8, (g) introducing the skins to a second dye bath, (h) fixing the dyestuff while reducing the pH level to a range of 3.0–3.5, (i) introducing the skins to a float containing an additional waterproofing agent, (j) fixing the waterproofing agent while reducing the pH level to approximately 3.0, (k) capping the skins to assure the fixation of penetrated waterproofing agents and to remove emulsifiers, (l) introducing the skins to a bath containing flame resistant agents, (m) drying the skins, (n) staking the skins, and (o) applying a waterproofing oil to the surface of the skins.

The present invention produces a soft and supple leather that is fire resistant, heat resistant and highly waterproof. This combination makes the leather particularly well-suited for a variety of application, including work footwear and motorcycle, ATV and other vehicle riding footwear. As described in more detail below, standard industry tests show that the leather produced using a preferred embodiment of the present invention provides a uniquely high combination of heat resistance, flame resistance, waterproofness and water vapor permeability.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
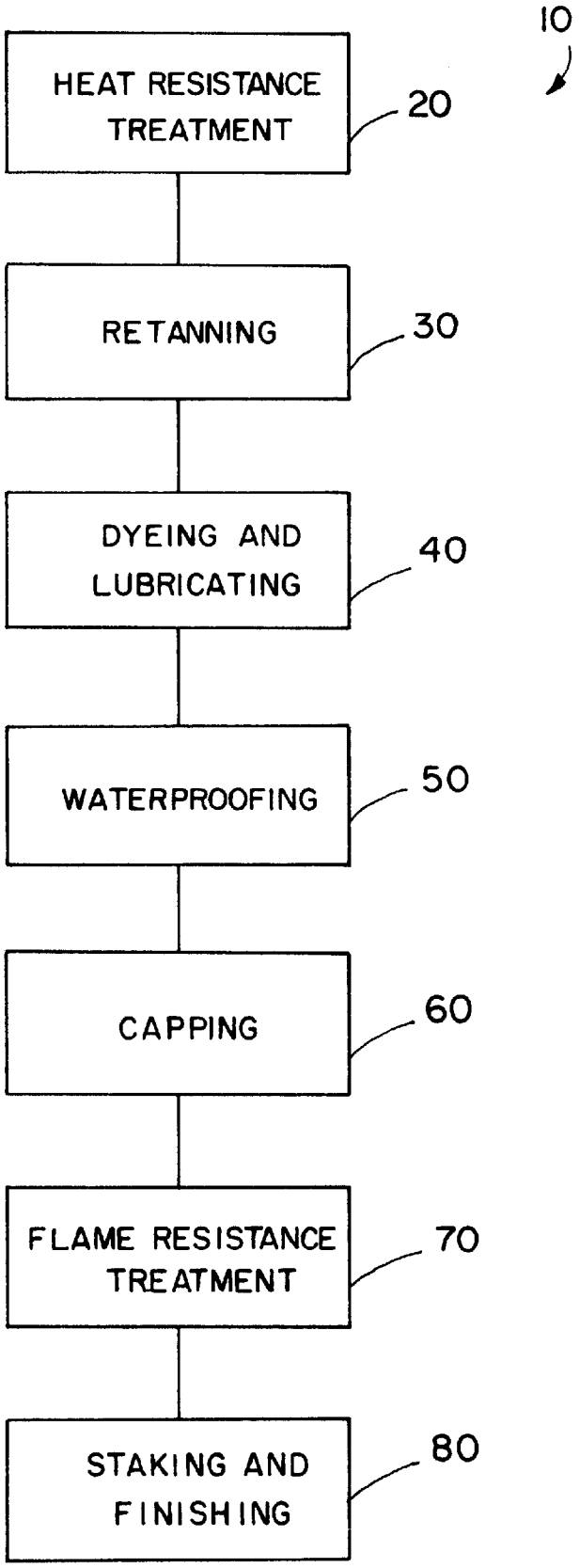
FIG. 1 is a flow chart showing the general steps of the present invention.

A preferred embodiment of the present invention is described in connection with the flowchart of FIG. 1. As shown in FIG. 1, the present method 10 generally includes the steps of (a) heat resistance treatment of the skins 20, (b) retanning the skins 30, (c) dyeing and lubricating the skins 40, (d) waterproofing the skins 50, (e) capping the skins 60, (f) flame resistant treatment of the skins 70, and (g) staking and finishing the skins 70. Together, these steps provide leather having a unique and highly advantageous combination of features and characteristics. The method is particularly well-suited for use in treating wet blue pig skins, but can be used in whole or in part to treat other skins as well. In some applications, the process may require routine modification to provide optimal results depending, for example, on the type and specific characteristics of the skins to be treated and on the specifically desired characteristics of the finished leather. The manner and degree of any such modifications will be readily apparent to those skilled in the art.

The following description sets forth an embodiment of the present invention that is optimized to provide finished leather with a particular set of desired characteristics. Those skilled in the field will readily appreciate that the specified times and quantities are approximate and that some variation in a specified time or in a specified quantity will typically yield acceptable results in the finished leather, and adjustments can be used to intentionally adjust the characteristics of the finished leather. The amount of acceptable variation in a particular time or quantity will vary depending primarily on the amount of acceptable variance in the finished leather. For example, variations in the range of approximately ±20% in the quantity of a particular additive are likely to be acceptable for each of the additives, except for the acidic and caustic materials used to adjust the pH level of the float (i.e. formic acid, sodium formate, sodium bicarbonate and aqua ammonia). However, even with the acidic and caustic materials, variation in the quantity of a particular additive may be compensated for by adjustment in the strength (e.g. percent of composition) of the additive or in time that the mill is run with the additive in the float provided that the specified pH levels are obtained. It should further be noted that, in the following paragraphs, the percentages of various additives are specified in parentheses following the specified weight or volume quantities. These percentages refer to the weight of the additive with respect to the total weight of the wet blue skins being processed.

In the preferred embodiment, the process begins by loading the wet blue skins into a conventional mill. In this embodiment, approximately 1000 lbs. of skins are loaded into the mill. Typically, the wet blue skins have a pH of 3.5 or lower. Initially, approximately 240 gallons of water are added to the mill to create the float. The water is preferably at a temperature of approximately 140° Fahrenheit (F). The mill is then run for approximately 15 minutes. Following this, a degreasing agent is added to the mill. Preferably, approximately 3 lbs. (or 0.3%) of Borron SE-G (available from TFL USA/Canada Ltd.) is added to the mill through the door. Borron SE-G is a nonionic, degreasing agent, which degreases the skins and prepares them to receive further treatments. Obviously, the Borron SE-G can be replaced by other degreasing agents, as desired. An additional approximately 120 gallons of water at 140° F. are then added to the mill, and the mill is run for approximately 15 minutes. The skins are then washed in approximately 1,222 gallons of water at 100° F. After washing, the water is drained from the mill.

Figure 2:
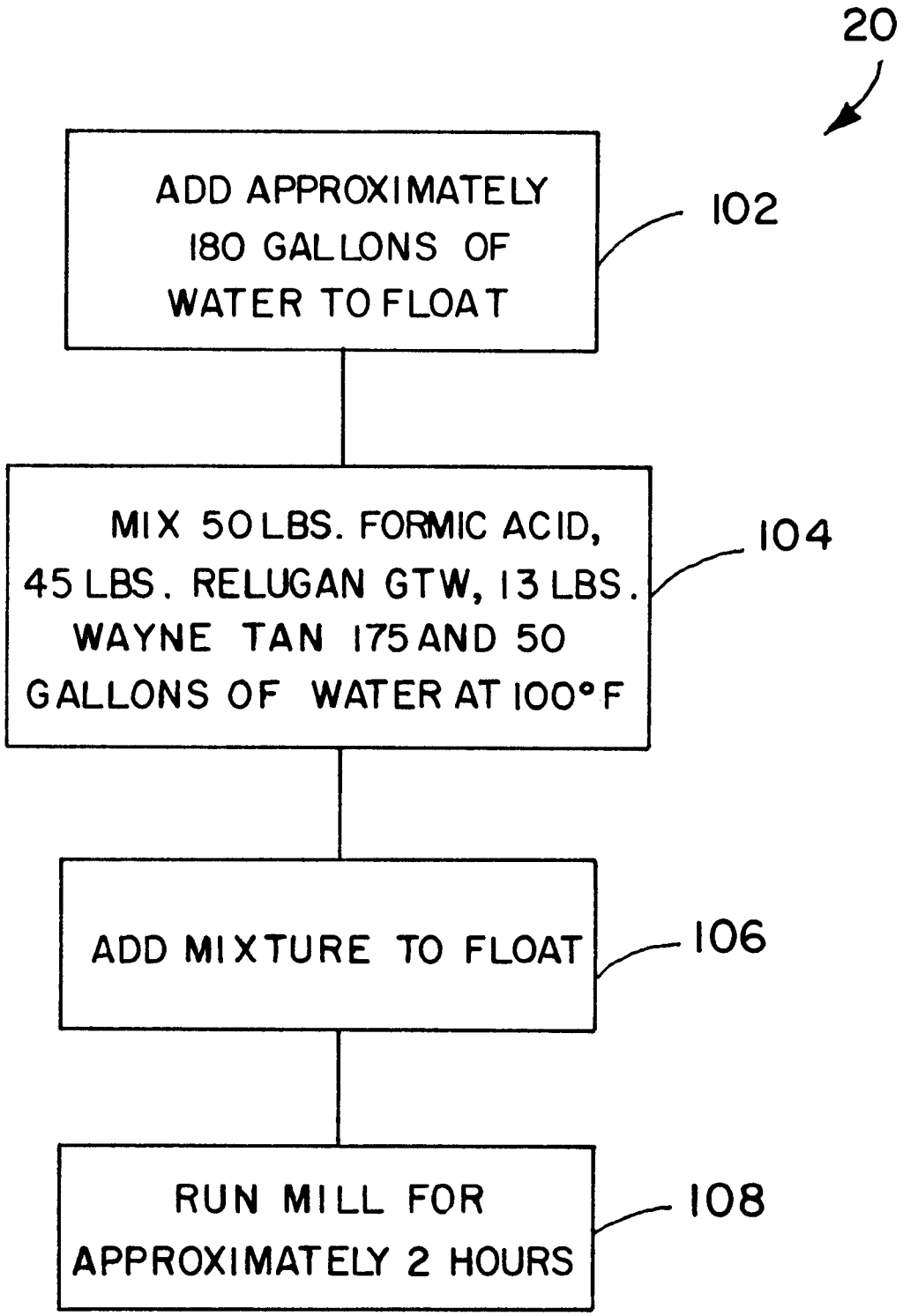
FIG. 2 is a flow chart showing the general sub-steps of the heat resistant step.

Next, the skins are treated 20 with a liquid chrome solution that contributes to the heat resistance of the finished leather (see FIG. 2). Approximately 180 gallons of water at 100° F. are added 102 to the mill to prepare for this stage of treatment. Approximately 5.0 lbs. (or 0.5%) of commercial grade formic acid (90% concentration), 45.0 lbs. (or 4.5%) of Relugan GTW (available from BASF Corporation), 130 lbs. (or 13%) of Wayne Tan 175 (available from Elementis Plc.), and 50 gallons of water at 100° F. are mixed together 104 and then added 106 to the float. Once these additives have been loaded, the mill is run 108 for approximately 2 hours. The Wayne Tan 175 is a liquid chrome solution, which, as noted above, contributes to the heat resistance of the finished leather. The Relugan GTW includes glutaraldehyde, which helps to reduce shrinkage. Those skilled in the field will readily appreciate that the Wayne Tan 175 can be replaced by other liquid chrome solutions or other heat resistance additives, and that the Relugan GTW can be replaced by other glutaraldehyde additives or other shrink-resistance additives. Preferably, a commercial grade, formic acid solution with a concentration of approximately 90% is used in this and the subsequently described steps that call for the introduction of formic acid. The form and concentration of formic acid can vary from application to application, and may, if desired, be replaced by other additives that function to lower the pH level in the mill. Alternatives are likely, however, to require variation in the quantity of the additive or the time that the mill is run with the additive in the float.

Figure 3:
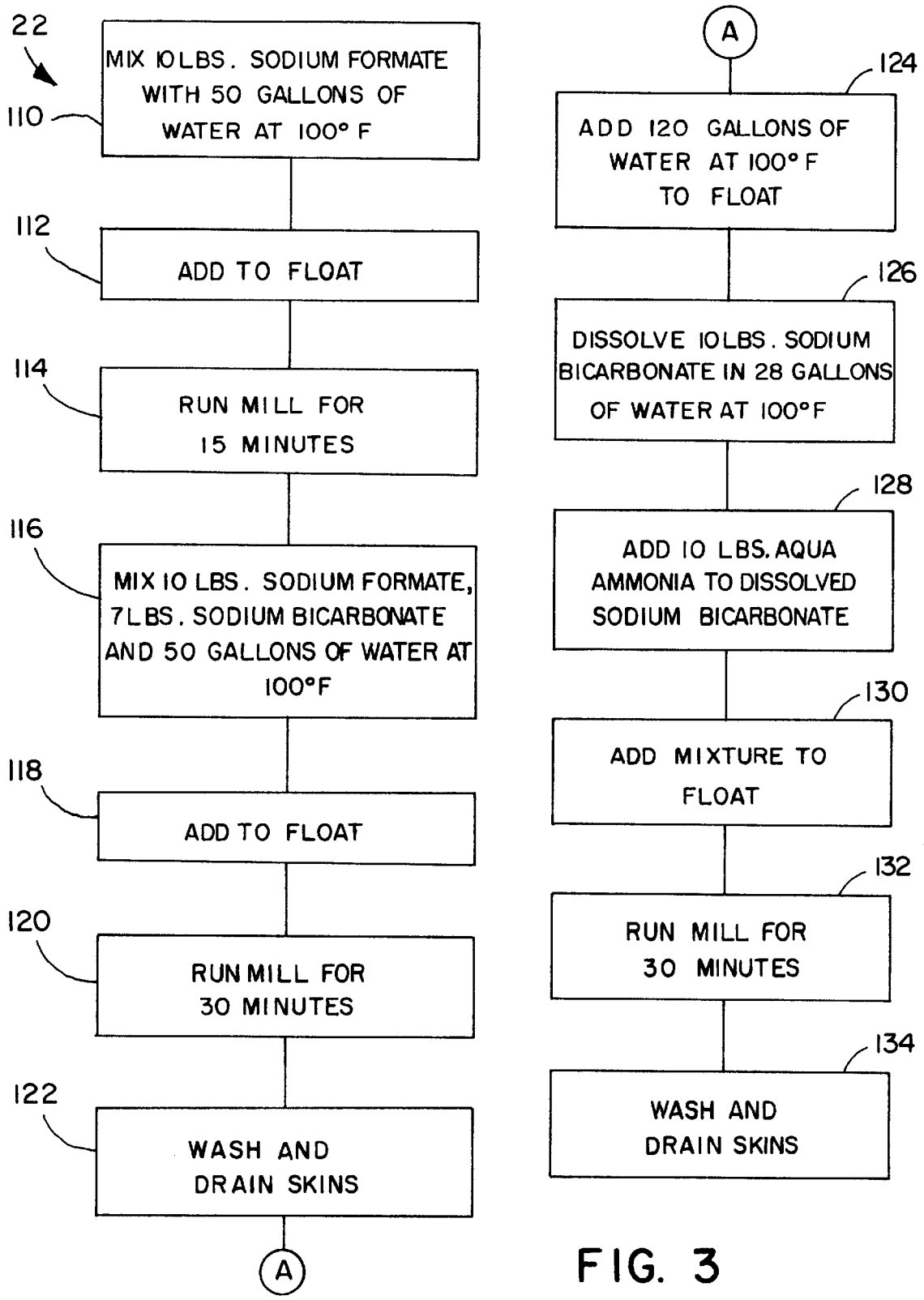
FIG. 3 is a flow chart showing the general steps of the neutralizing stage.

Following these steps, the skins are neutralized 22 to prepare for the retanning steps (see FIG. 3). In the preferred embodiment, the neutralization process includes two stages. In the first stage, approximately 10.0 lbs. of sodium formate (or 1%) and 50 gallons of water at 100° F. are mixed 110 and then added 112 to the mill. The mill is then run 114 for approximately 15 minutes. Next, approximately 10.0 lbs. of sodium formate (or 1%), 7.0 lbs. of sodium bicarbonate (or 0.7%) and 50 gallons of water at 100° F. are mixed 116 and then added 118 to the mill. The mill is then run 120 for approximately 30 minutes, or until the pH level of the skins is in the range of approximately 4.0 to 4.5. Then, approximately 778 gallons of water at 100° F. are added to the mill, and the skins are washed and drained 122.

In the second stage of the neutralization process, approximately 120 gallons of water at 100° F. are added 124 to the mill. Approximately 10.0 lbs. (or 1%) of sodium bicarbonate, 10.0 lbs. (or 1%) of commercial grade aqueous ammonia (29% concentration) and 28 gallons of water at 100° F. are then added to the mill. Preferably, the sodium bicarbonate is first dissolved 126 in the water. The ammonia is then added 128 and the combination is added 130 to the float. The mill is then run 132 for approximately 30 minutes. After the 30 minutes has expired, approximately 778 gallons of water at 100° F. are added to the mill, and the skins are washed and drained 134. At the end of this stage, the skins are sufficiently neutralized having a pH level of approximately 6.0 or above, and most preferably 6.5 or above.

Figure 4:
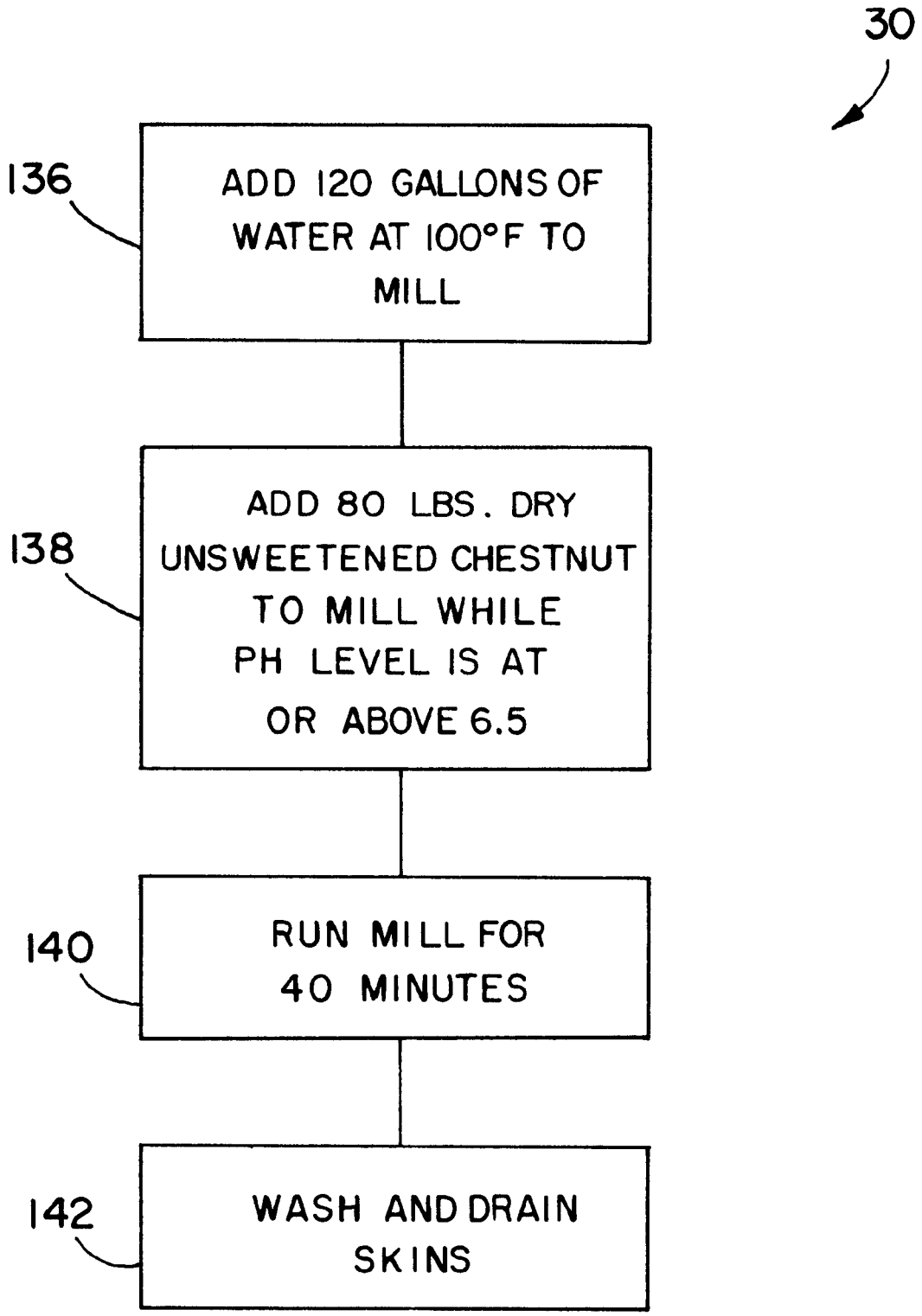
FIG. 4 is a flow chart showing the general sub-steps of the retanning step.

The neutralized skins are then treated in the retanning phase 30 (see FIG. 4). Once again, approximately 120 gallons of water at 100° F. are added 136 to the mill to create the float. Then, approximately 80.0 lbs. of dry chemical unsweetened chestnut is added 138 to the mill. Chestnut is a well-known vegetable tanning agent that functions as a filling agent making the finished leather firmer and denser, and is readily available from a variety of well-known suppliers. Unsweetened chestnut is preferred over sweetened chestnut in this application as it typically performs better with highly waterproof leathers. Those skilled in the art will readily appreciate that the chestnut can be replaced by other vegetable tanning agents, or other non-vegetable tanning agents as desired. The mill is then run 140 for approximately 40 minutes. After 40 minutes, approximately 778 gallons of water at 100° F. are added to the mill, the skins are washed and the mill is drained 142.

Figure 5:
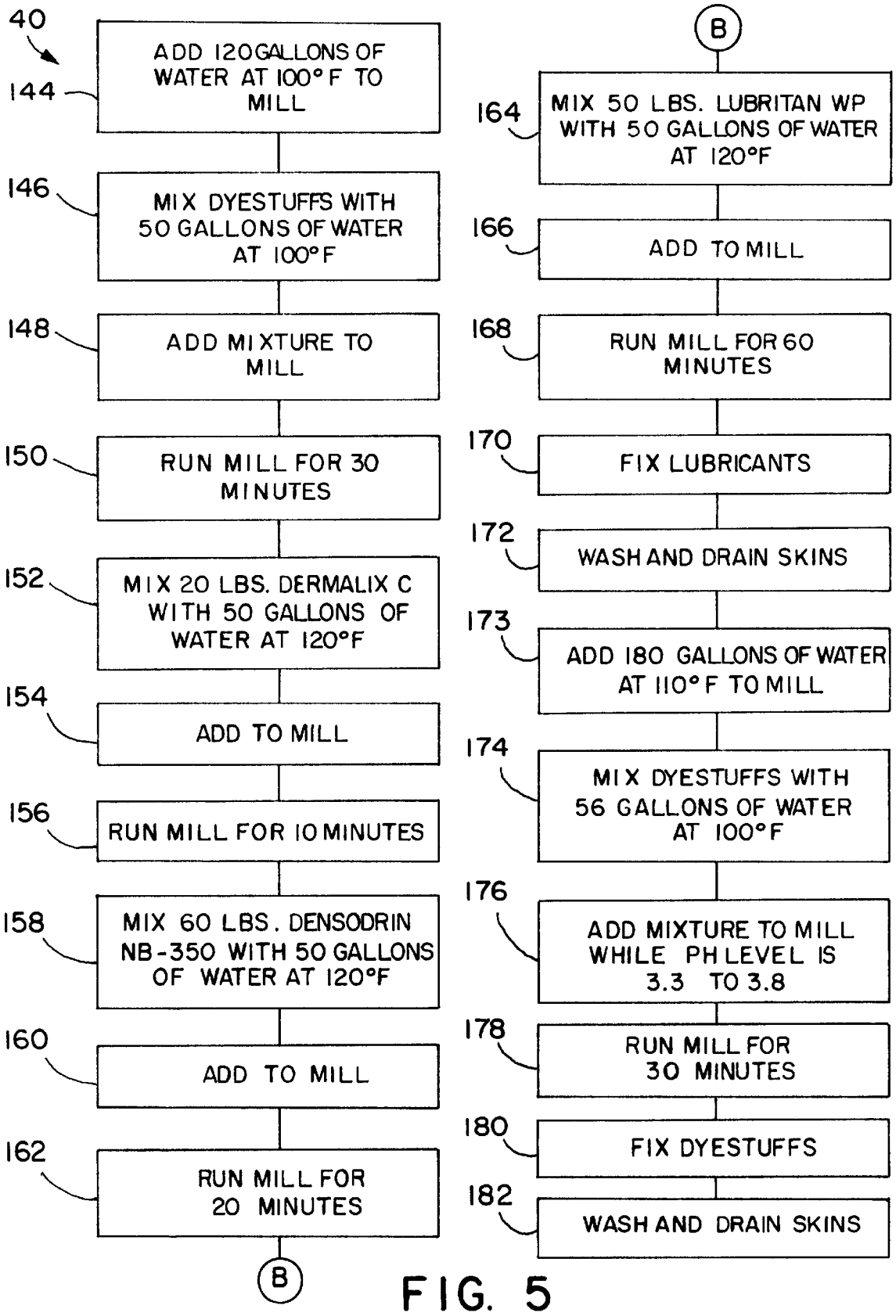
FIG. 5 is a flow chart showing the general sub-steps of the dyeing and lubricating steps.

The retanned skins are next dyed and lubricated 40 (see FIG. 5). In the preferred embodiment, two separate installments of dye are applied to the skins with the lubricants being applied to the skins between the two dye applications. This provides more consistent and uniform color, both within the skin and on the surface. Plus, it provides a better color build up. To prepare for the dyeing and lubricating steps, approximately 120 gallons of water at 100° F. are added 144 to the mill. A first installment of dye is then added to the mill. In this embodiment, the desired color is black. Accordingly, approximately 62.0 lbs. (or 6.2%) of Avacor Black TKK Liquid (available from Tannin Corporation), 48.0 lbs. (or 4.8%) of Sandoderm Black R Liquid (available from Clariant Corp.), approximately 13.5 lbs. (or 1.35%) of Sandoderm Orange G Liquid (available from Clariant Corp.) and approximately 50.0 gallons of water at approximately 100° F. are mixed together 146. The mixture is then pumped 148 into the mill, and the mill is run 150 for approximately 30 minutes. As will be readily apparent to those skilled in the art, the identified dyestuffs may be replaced by other liquid waterbase acid dyestuffs or powder dyestuffs to obtain the desired color.

Next, the lubricants or lubricating agents are applied to the skins. Approximately 20.0 lbs. (2%) of Dermalix C paste (available from Clariant Corp.) and approximately 50.0 gallons of water at approximately 120° F. are mixed 152 and then added 154 to the mill. The mill is then run 156 for approximately 10 minutes. Following the 10 minutes, approximately 60.0 lbs. (6%) of Desodrin NB-350 (available from BASF Corporation) and approximately 50.0 gallons of water at approximately 120° F. are mixed 158 and added 160 to the mill. The mill is then run 162 for approximately 20 minutes. Next, approximately 50.0 lbs. (5%) of Lubritan WP (available from Rohm and Haas Company) and approximately 50.0 gallons of water at approximately 120° F. are mixed 164 and added 166 to the mill. The mill is then run 168 for approximately 60 minutes. It should be noted that each of these lubricating agents is to some degree a waterproofing agent. Accordingly, the application of these lubricants is to a certain degree a component of the waterproofing of the skins. Those skilled in the field will readily appreciate and understand that the identified lubricating agents can be replaced with other conventional lubricating agents, as desired.

To aid in fixing 170 the dye and lubricants in the skins, formic acid is added to the mill in two sequential installments. First, approximately 7.5 lbs. of formic acid (90% concentration) is added to the mill along with approximately 11 gallons of water at 100° F. The mill is run for approximately 15 minutes. Then, a second installment of approximately 7.5 lbs. of formic acid (90% concentration) and 11 gallons of water at 100° F. are added to the mill. The mill is then run for approximately 15 minutes or until the pH is in the range of 3.3 to 3.8. This helps to prevent the second application of dyestuff (discussed below) from being adsorbed into the skins, and instead causes the second application of dyestuff to provide the skin with the desired surface color. After the skins reach the appropriate pH level, they are washed in approximately 778 gallons of water at 110° F., and the mill is drained 172.

To provide the desired depth of color to the surface of the skin, a second installment of dye is then applied to the skins. To prepare for this step, approximately 180 gallons of water at 110° F. are added 173 to the mill. Then, the mill is lowered to the appropriate pH level by adding approximately 7.5 lbs. (or 0.75%) of formic acid (90% concentration) and 11 gallons of water at 100° F. The mill is then run for approximately 15 minutes. Next, the dyestuffs are added. Approximately 62.0 lbs. (or 6.2%) of Avacor Black TKK Liquid, approximately 48.0 lbs. (or 4.8%) of Sandoderm Black R Liquid and approximately 13.5 lbs. (or 1.35%) of Sandoderm Orange G Liquid are mixed 174 with approximately 56 gallons of water at 100° F. The mixture is added 176 to the mill and the mill is run 178 for approximately 30 minutes. Formic acid is then added to the mill to fix 180 the dyestuffs. Preferably, approximately 10.0 lbs. of formic acid (90% concentration) and 11 gallons of water at 100° F. are added to the mill and the mill is run for approximately 15 minutes or until the pH level is in the range of 3.0 to 3.5. After the skins reach the appropriate pH level, they are washed in approximately 778 gallons of water at 110° F. The mill is then drained 182.

Figure 6:
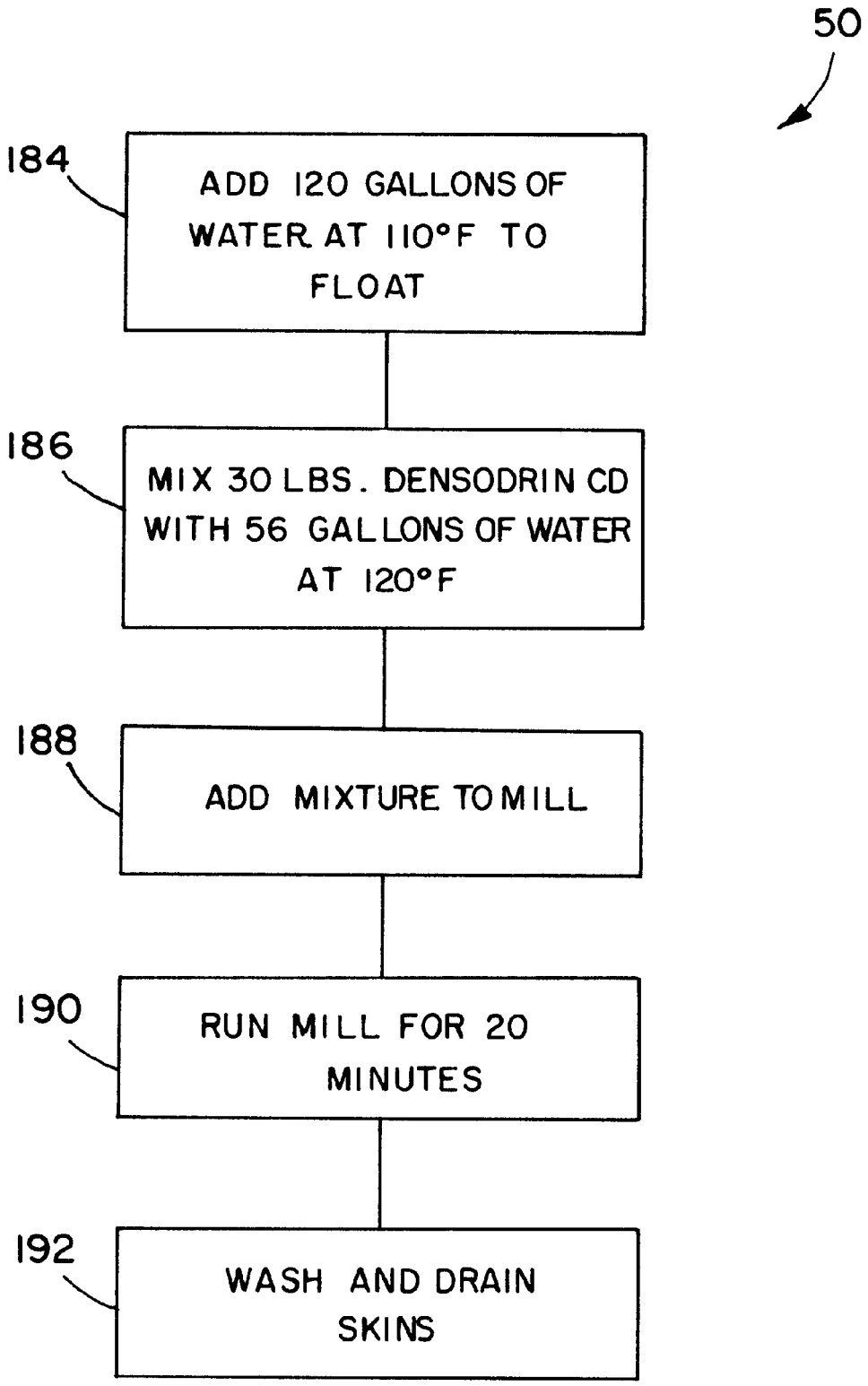
FIG. 6 is a flow chart showing the general sub-steps of the waterproofing step.
Figure 7:
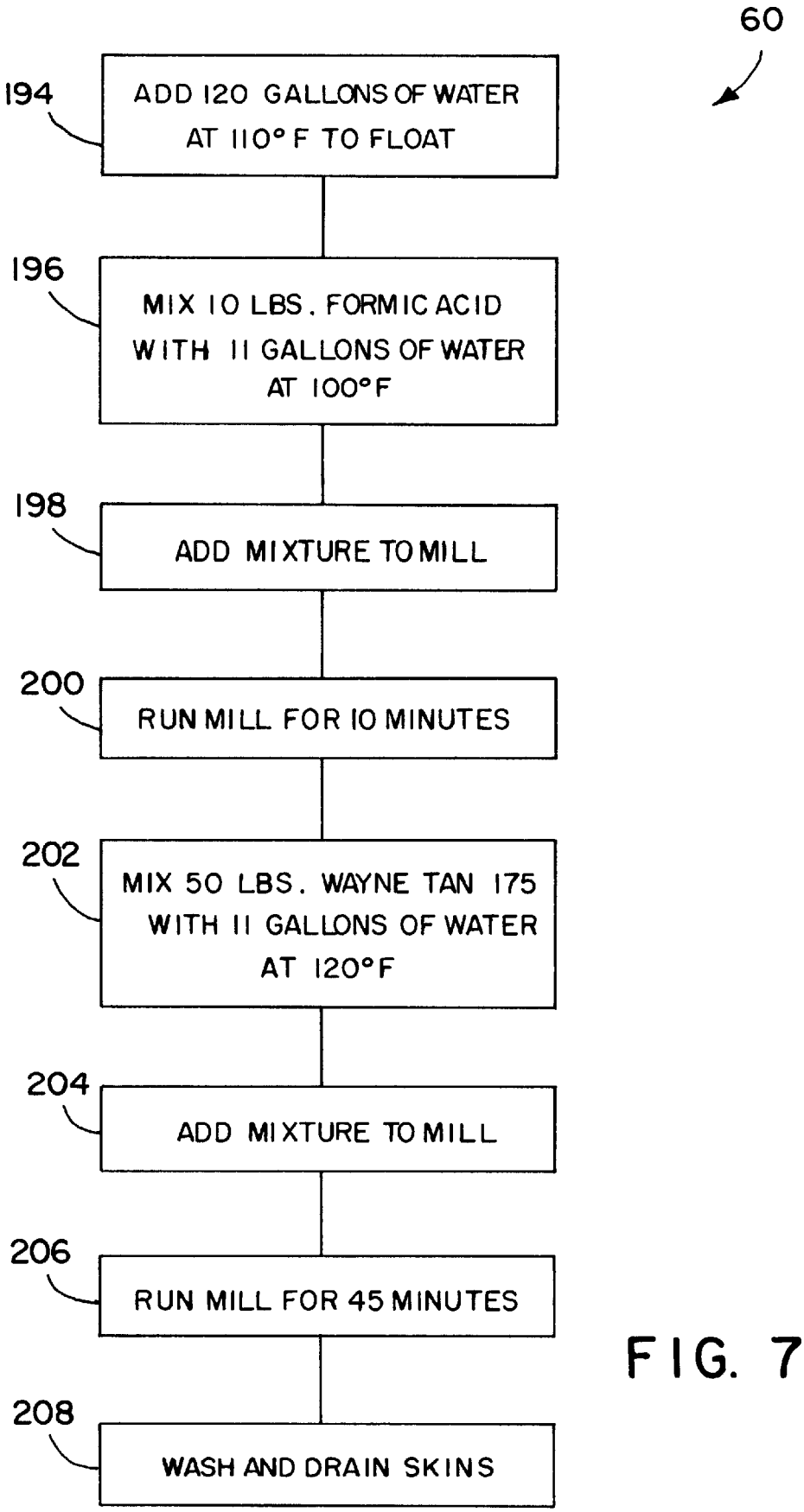
FIG. 7 is a flow chart showing the general sub-steps of the capping step and FIG. 8 is a flow chart showing the general sub-steps of the flame resistant step.

Next, a waterproofing agent is applied 50 to the skins (see FIG. 6). To prepare for application of the waterproofing agent, approximately 120 gallons of water at 110° F. are added 184 to the mill. Then, approximately 30.0 lbs. (or 3%) Densodrin CD (available from BASF Corporation) and 56 gallons of water at 120° F. are mixed 186 and added 188 to the float. The mill is run 190 for approximately 20 minutes. Densodrin CD is a silicone-based waterproofing agent that includes emulsifiers that break down the non-water-soluble waterproofing agent to permit it to penetrate the skins. The skins are then washed in approximately 778 gallons of water at 110° F., and the mill is drained 192.

The next step is the capping step 60, which fixes the waterproofing agent and removes any residual emulsifiers. This is done by first adding 194 approximately 120 gallons of water at 110° F. Then, approximately 10.0 lbs. of formic acid (90% concentration) are mixed 196 with approximately 11 gallons of water at 100° F. The mixture is added 198 to the mill and the mill is run 200 for 10 minutes or until the pH level of the skins is approximately 3.0. Next, approximately 50.0 lbs. (or 5%) of Wayne Tan 175 and 11 gallons of water at 120° F. are mixed 202 and added 204 to the float. The mill is run 206 for approximately 45 minutes. This removes the emulsifiers introduced to the mill with the waterproofing agent. This step also makes sure that the waterproofing chemicals previously applied are fixed in the fibers of the skins. The skins are then washed in approximately 778 gallons of water at 130° F., and the mill is drained 208.

Figure 8:
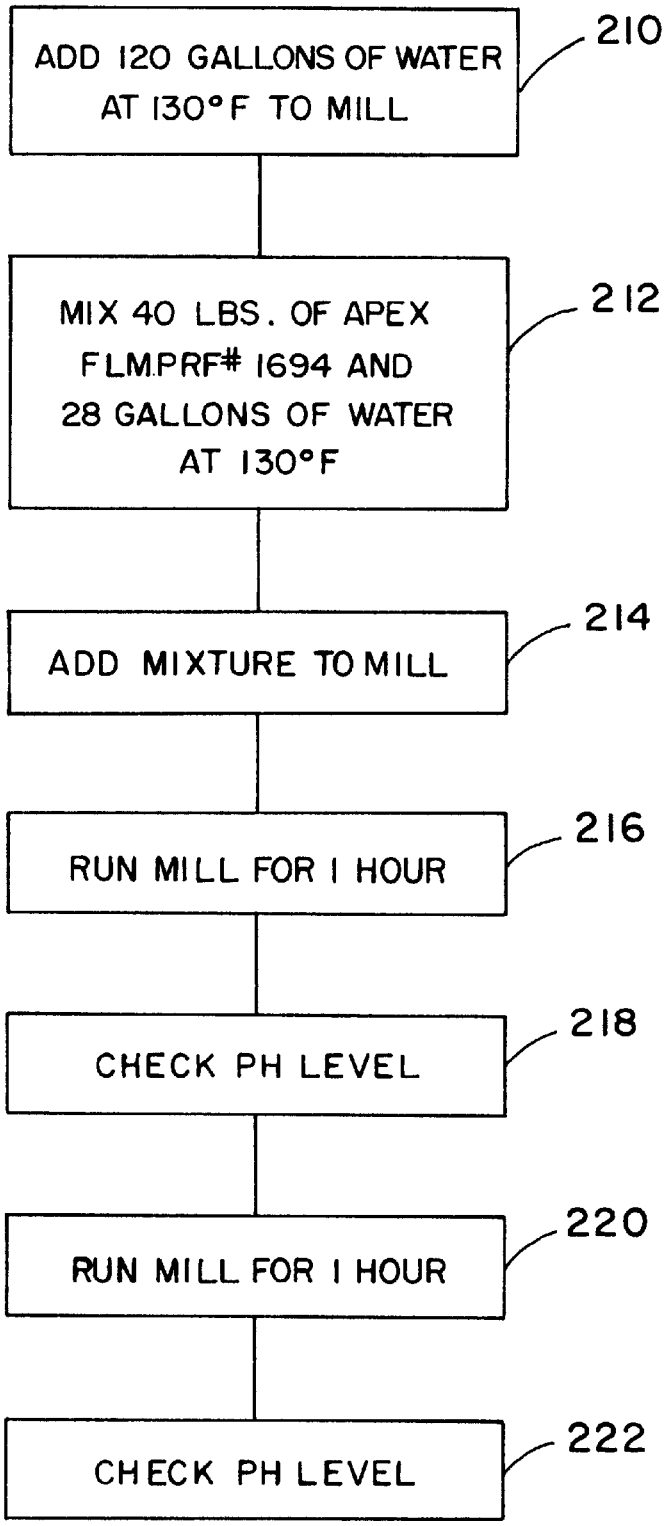

A flame resistant agent is next applied 70 to the skins (see FIG. 8). To prepare for this step, approximately 120 gallons of water at approximately 130° F. are added 210 to the mill. Then, 40.0 lbs. (or 4.0%) of Apex FLMPRF#1694 (available from Apex Chemical Corporation) and approxinately 28 gallons of water at 130° F. are mixed 212 and then added 214 to the mill. The mill is then run 216 for an hour and then checked 218 to ensure that the pH level is in the range of 3.2 to 3.5. The mill is then run 220 for a second hour. At the end of this second hour the pH level of the skins is again checked 222 to ensure that it is within the range of 3.2 to 3.5. If the pH level is not within the desired range during either of these tests, it may be necessary to adjust the pH level of the skins and rerun the mill for the corresponding hour-long period to ensure proper application of the flame resistant agent. The mill is then drained.

Next, the skins are subjected to a final washing. Approximately 333 gallons of water at 80° F. are added to the mill while the mill is running. The washing door of the mill is preferably left open, permitting the water to slosh from the mill. The mill is run until nearly all of the water has sloshed from the mill. Then, the skins or leathers are dumped from the mill.

The leathers are preferably dried using conventional vacuum dryers or other similar machinery. The dried leathers can be staked and finished 80 as desired. Staking is a mechanical softening process that typically involves beating the leather repeatedly with small fingers. The leathers can then be finished as desired. For example, oil can be applied to the leather to add to waterproofness and change the look and feel of the leather. Oil can be applied in any of a number of conventional ways. One such way is through the use of a reverse roller coater. Preferably, 4–6 grams of oil is applied per square foot of leather. It has been found that Neodri Hadgco 343 oil (available from Hodgson) is particularly well-suited for use in this step. To soften the leather, it is preferable to give the leather a final tumbling for about one hour prior to the application of the oil. Afterwards, the oiled skins are piled together with the oiled surfaces face-to-face. Then, the skins are roll pressed at approximately 250° F. to bring the Neodri Hadgco 343 oil to the surface and to smooth the grain.

As noted above, the present invention provides leather having a uniquely high combination of heat resistance, flame resistance, water vapor permeability and waterproofness. Standard water vapor permeability tests performed in accordance with ASTM D 5052-96 on leather manufactured in accordance with the above described preferred embodiment show that the leather has a water vapor permeability rating of 450 gms/m$^2$/day. Standard heat resistance tests performed in accordance with NFPA-1971 (1997) at 500° F. for 5 minutes showed only 20% shrinkage and at 450° F. for 5 minutes showed a mere 12.5% shrinkage. Further, standard flammability resistance tests performed in accordance with NFPA-1971(1997) showed no after flame, a char length of 0.1 inches and no melting or dripping. Finally, standard waterproofness tests performed in accordance with ASTM D 2099-98 showed that the leather has a waterproofness rating of 250,000 Maeser flexes.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A method for producing leather from skins, comprising the steps of:

applying a liquid chrome solution to the skins while the skins are at or below a pH level of approximately 3.5;

neutralizing the skins by raising the pH level of the skins to at least approximately 6.0 or above;

retanning the skins by applying a tanning agent while the skins are within the pH level range of at least approximately 6.0 or above;

lowering the pH level of the skins to within a range of approximately 3.0 to 3.5;

applying a waterproofing agent to the skins;

fixing the waterproofing agent within the skins by lowering the pH level of the skins to at or below approximately 3.0;

applying a flame resistant agent to the skins; and fixing the flame resistant agent within the skins by raising the pH level of the skins to within a range of approximately 3.2 to 3.5.

2. The method of claim 1 further comprising the step of applying an oil to the skins following said step of fixing the flame resistant agent.

3. The method of claim 2 further comprising the step of applying a dye to the skins following said retanning step.

4. The method of claim 3 wherein said step of applying a dye to the skins includes the steps of:

applying a first dye to the skins following said retanning step;

reducing the pH level of the skins to within a range of approximately 3.3 to 3.8; and applying a second dye to skins while the pH level of the skins remains within the range of approximately 3.3 to 3.8.

5. The method of claim 4 further comprising the step of capping the skins following said step of fixing the waterproofing agent and prior to said step of applying a flame resistant agent.

6. The method of claim 5 further comprising the step of applying a glutaraldehyde to the skins prior to said retaining step.

7. The method of claim 6 wherein said step of applying a liquid chrome solution is performed in a float of water at approximately 100° F.

8. The method of claim 7 wherein said retanning step is performed in a float of water at approximately 100° F.

9. The method of claim 8 wherein said step of neutralizing the skins is performed in a float of water at approximately 100° F.

10. The method of claim 9 further comprising the step of applying lubricants to the skins following said step of applying a first dye to the skins and prior to said step of applying a second dye to the skins, said step of applying lubricants to the skins performed in a float of water at approximately 120° F.

11. The method of claim 10 wherein said step of applying a first dye to the skins is performed in a float of water at approximately 100° F.

12. The method of claim 11 wherein said step of applying a second dye to the skins is performed in a float of water at approximately 110° F.

13. The method of claim 12 wherein said step of applying a waterproofing agent to the skins is performed in a float of water at approximately 100° F.

14. The method of claim 13 wherein said step of applying a flame resistant agent to the skins is performed in a float of water at approximately 100° F.

15. A method for producing leather from skins, comprising the steps of:

introducing the skins into a mill;

applying a liquid chrome solution to the skins by introducing the liquid chrome solution into the mill;

neutralizing the skins by introducing a base into the mill to raise the pH level of the skins to at least approximately 6.0 or greater;

retanning the skins by introducing a tanning agent into the mill;

lowering the pH level of the skins to within a range of approximately 3.0 to 3.5 by introducing an acid into the mill;

applying a waterproofing agent to the skins by introducing the waterproofing agent into the mill while the pH level of the skins is within a range of approximately 3.0 to 3.5;

fixing the waterproofing agent within the skins by introducing an acid into the mill to lower the pH level of the skins to at or below approximately 3.0;

applying a flame resistant agent to the skins by introducing the flame resistant agent into the mill; and fixing the flame resistant agent within the skins by reducing the pH level of the skins to within a range of approximately 3.2 to 3.5.

16. The method of claim 15 further comprising the steps of:

removing the skins from the mill following said step of fixing the flame resistant agent; and applying an oil to the skins following said step of removing the skins from the mill.

17. The method of claim 16 further comprising the step of dyeing the skins by introducing a dyestuff into the mill following said retanning step.

18. The method of claim 17 wherein said step of applying a dye to the skins includes the steps of:

introducing a first dye into the mill following said retanning step;

lowering the pH level of the skins to within a range of approximately 3.3 to 3.8 by introducing an acid into the mill; and introducing a second dye into the mill while the pH level of the skins remains within the range of approximately 3.3 to 3.8.

19. The method of claim 18 further comprising the step of lubricating the skins by introducing a lubricating agent into the mill following said step of introducing a first dye and prior said step of introducing a second dye.

20. The method of claim 19 further comprising the step of capping the skins by introducing a additive into the mill to remove emulsifiers, said capping step following said step of fixing the waterproofing agent and prior to said step of applying a flame resistant agent.

21. The method of claim 20 further comprising the step of introducing a glutaraldehyde into the mill prior to said retanning step to reduce shrinkage of the skins.

22. The method of claim 21 wherein said step of applying a liquid chrome solution is performed while the mill is at a temperature of approximately 100° F.

23. The method of claim 22 wherein said retanning step is performed while the mill is at a temperature of approximately 100° F.

24. The method of claim 23 wherein said step of neutralizing the skins is performed while the mill is at a temperature of approximately 100° F.

25. The method of claim 24 wherein said step of applying lubricants to the skins is performed while the mill is at a temperature of approximately 120° F.

26. The method of claim 25 wherein said step of introducing a first dye is performed while the mill is at a temperature of approximately 100° F.

27. The method of claim 11 wherein said step of introducing a second dye is performed while the mill is at a temperature of approximately 110° F.

28. The method of claim 27 wherein said step of applying a waterproofing agent is performed while the mill is at a temperature of approximately 100° F.

29. The method of claim 13 wherein said step of applying a flame resistant agent is performed while the mill is at a temperature of approximately 100° F.

30. A method for producing leather from pig skins, comprising the steps of:

introducing wet blue pig skins into a mill containing a float of water, the skins having a weight;

applying a liquid chrome solution to the skins by introducing the liquid chrome solution into the water and running the mill for at least approximately two hours, the liquid chrome solution having a weight of approximately 13 percent of the weight of the skins;

neutralizing the skins by introducing a base into the water and running the mill until the pH level of the skins is at least approximately 6.0 or above;

retanning the skins by introducing a tanning agent into the water and running the mill for at least approximately 40 minutes, the tanning agent having a weight of approximately 8 percent of the weight of the skins;

lowering the pH level of the skins by introducing an acid into the water and running the mill until the pH level is within a range of approximately 3.0 to 3.5;

applying a waterproofing agent to the skins by introducing the waterproofing agent into the water while the pH level of the skins is within a range of approximately 3.0 to 3.5 and running the mill for at least approximately 20 minutes, the waterproofing agent having a weight of approximately 3 percent of the weight of the skins;

fixing the waterproofing agent within the skins by introducing an acid into the water and running the mill until the pH level of the skins is at or below approximately 3.0;

applying a flame resistant agent to the skins by introducing the flame resistant agent into the water and running the mill for at least approximately 1 hour, the flame resistant agent having a weight of approximately 4 percent of the weight of the skins; and fixing the flame resistant agent within the skins by reducing the pH level of the skins to within a range of approximately 3.2 to 3.5.

31. A method for producing leather from pig skins, comprising the steps of:

introducing wet blue pig skins into a mill containing a float of water at approximately 140° F.;

degreasing the skins by introducing a degreasing agent into the water and running the mill for at least approximately 15 minutes;

draining the water from the mill and resupplying the mill with water at approximately 100° F.;

applying a liquid chrome solution to the skins by introducing the liquid chrome solution into the water and running the mill for at least approximately two hours;

neutralizing the skins by introducing a base into the water and running the mill until the pH level of the skins is at least approximately 6.0 or greater;

draining the water from the mill and resupplying the mill with water at approximately 100° F.;

retanning the skins by introducing a tanning agent into the water and running the mill for at least approximately 40 minutes;

lowering the pH level of the skins by introducing an acid into the water and running the mill until the pH level is within a range of approximately 3.0 to 3.5;

draining the water from the mill and resupplying the mill with water at approximately 110° F.;

applying a waterproofing agent to the skins by introducing the waterproofing agent into the water while the pH level of the skins is within a range of approximately 3.0 to 3.5 and running the mill for at least approximately 20 minutes;

draining the water from the mill and resupplying the mill with water at approximately 110° F.;

fixing the waterproofing agent within the skins by introducing an acid into the water and running the mill until the pH level of the skins is at or below approximately 3.0;

draining the water from the mill and resupplying the mill with water at approximately 130° F.;

applying a flame resistant agent to the skins by introducing the flame resistant agent into the water and running the mill for at least approximately 1 hour; and fixing the flame resistant agent within the skins by reducing the pH level of the skins to within a range of approximately 3.2 to 3.5.

* * * * *

UNITED STATES PATENT AND TRADEMARK OFFICE

CERTIFICATE OF CORRECTION

PATENT NO. : 6,395,040 B1
DATED : May 28, 2002
INVENTOR(S) : Tulgar

It is certified that error appears in the above-identified patent and that said Letters Patent is hereby corrected as shown below:

Title page,
Item [57], ABSTRACT,
Line 5, "retaining" should read -- retanning --

Column 8,
Line 39, "retaining" should be -- retanning --

Signed and Sealed this

Twenty-third Day of July, 2002

*Attest:*

*Attesting Officer*

JAMES E. ROGAN
*Director of the United States Patent and Trademark Office*